US010688648B2

(12) United States Patent
Ni et al.

(10) Patent No.: US 10,688,648 B2
(45) Date of Patent: Jun. 23, 2020

(54) MULTI-COMPONENT QUICK ASSEMBLY HANDLE

(71) Applicants: Kurt Ni, Taipei (TW); Patrick H. Monahan, Arcola, IL (US)

(72) Inventors: Kurt Ni, Taipei (TW); Patrick H. Monahan, Arcola, IL (US)

(73) Assignee: MONAHAN PARTNERS, INC., Arcola, IL (US)

( * ) Notice: Subject to any disclaimer, the term of this patent is extended or adjusted under 35 U.S.C. 154(b) by 7 days.

(21) Appl. No.: 16/206,286

(22) Filed: Nov. 30, 2018

(65) Prior Publication Data

US 2019/0134805 A1 May 9, 2019

Related U.S. Application Data

(63) Continuation-in-part of application No. 14/961,200, filed on Dec. 7, 2015, now Pat. No. 10,052,753.

(51) Int. Cl.
*B25G 1/10* (2006.01)
*B25G 3/36* (2006.01)
*B25G 1/04* (2006.01)

(52) U.S. Cl.
CPC ..... *B25G 1/102* (2013.01); *B25G 1/04* (2013.01); *B25G 3/36* (2013.01)

(58) Field of Classification Search
CPC ... B25G 1/10; B25G 1/04; B25G 3/16; B25G 3/26; A46B 5/002; A47L 13/20
See application file for complete search history.

(56) References Cited

U.S. PATENT DOCUMENTS 7,478,453 B1 * 1/2009 Busshaus ..... A47L 13/38 15/144.3
2003/0233718 A1 * 12/2003 Heathcock ..... B25G 1/04 15/144.4
2003/0235463 A1 * 12/2003 Neumann ..... B25G 1/04 403/329

* cited by examiner

*Primary Examiner* — Shay Karls
(74) *Attorney, Agent, or Firm* — R. William Graham

(57) ABSTRACT

A multi-component quick assembly handle includes tubular members made of a permanently formed material having a pin locking and friction fit connection.

20 Claims, 8 Drawing Sheets

MULTI-COMPONENT QUICK ASSEMBLY HANDLE

THIS IS A CONTINUATION-IN-PART AND CLAIMS THE BENEFITS OF U.S. SER. NO. 14/961,200 FILED DEC. 7, 2015 NOW U.S. PAT. NO. 10/052753.

BACKGROUND OF INVENTION

Field of the Invention

The instant invention relates to handles for handle held implements, such as broom and mops and other cleaning tools and long handled tools. More particularly, the invention relates to a multi-component quick assembly permanent handle.

Related Art

There exist many elongated handles for use with mops, brooms and other hand held implements. Typically, these handles are generally cylindrical and have an end adapted with a connector such as a threaded end to be received in a complementary threaded female opening of the cleaning implement.

There also exist handles which thread together to extend the length the handles. These type of interconnecting handles tend to be relatively expensive and less fixably stable. The threaded components tend to want to loosen as they are used. Multiple threaded components increases this tendency to loosen.

There are also various forms of telescoping handles, where a smaller diameter tube fits inside a larger diameter tube, which limits the places an attachment can be added—such as a clip. The telescoping handles have a means for setting the handles at a certain length. These handles are more expensive and almost always become loose over extended use and are limited to the size of the box they fit in as each piece must fit inside another.

There are many expensive multi-piece handles which when assembled, are never disassembled. The purchaser has paid for a feature he doesn't need.

Accordingly, there remains a need to provide a more economical, quickly assembled and substantially fixable interconnected handle. The invention meets the desired need to improve interconnected handles.

SUMMARY OF THE INVENTION

It is an object to improve handles for hand held implements.

It is yet another object to improve multi-component quick assembly handle and method of making same.

It is still another object to improve a method of making multi-component quick assembly handle.

Yet another improvement is to provide a multi-component quick assembly handle which is postal friendly.

Yet another improvement is to provide a multi-component quick assembly handle which, once assembled, is close to being a permanent length handle.

Still another improvement is to provide a multi-component quick assembly handle which provides a friction fit assembly with a biased locking pin to provide a tight fit connection while also assuring disconnect ability.

Accordingly, the invention is directed to a multi-component quick assembly handle. One aspect of the multi-component quick assembly handle includes a first tubular member made of a formed material having a first end permanently formed with a predetermined diameter and connecting to a second end forming a remaining portion of the first tubular member of a smaller diameter and having at least one (and preferably a pair of coaxially aligned) open surface(s) extending through the second end. Operably disposed in the second end is a biased pin which normally extends outside the open surface(s) and is capable of being depressed toward an interior of the second end.

There is also a second tubular member made of a formed material having a first end with a predetermined diameter substantially that of the first end of the first tubular member and connecting a second end forming a remaining portion of the second tubular member having a larger diameter and an inner diameter to complementary receive by way of a friction fit the second end of the first tubular member and having at least one (and preferably a pair of coaxially aligned) open surface(s) extending through the second end. With the pin depressed, the second ends can be connected and the member second ends respective open surface(s) can be coaxially aligned and the pin released to a relaxed position and thereby lock the tubular members in a relatively fixed position which provides a friction fit assembly while also assuring disconnect ability. At least one of the first ends having a connector for connecting a cleaning head, such as a mop or broom, to form a cleaning implement. Another embodiment employs intermediate tubular member(s) similarly formed for interconnection as described above.

The assembled invention replaces the previously described handles providing for multiple fixed length handles, filling the same functions and using the same storage space. The present invention can only be put together one way, thus making it a one-way assembly.

The invention is postal friendly. For example, United Parcel Services charges a $9 surcharge for packages at 48" or more in length. Many current cleaning tools are 48" or longer. The invention eliminates this charge by fitting the handle into a much smaller box, without loss of function.

DETAILED DESCRIPTION OF PREFERRED EMBODIMENT

Figure 1:
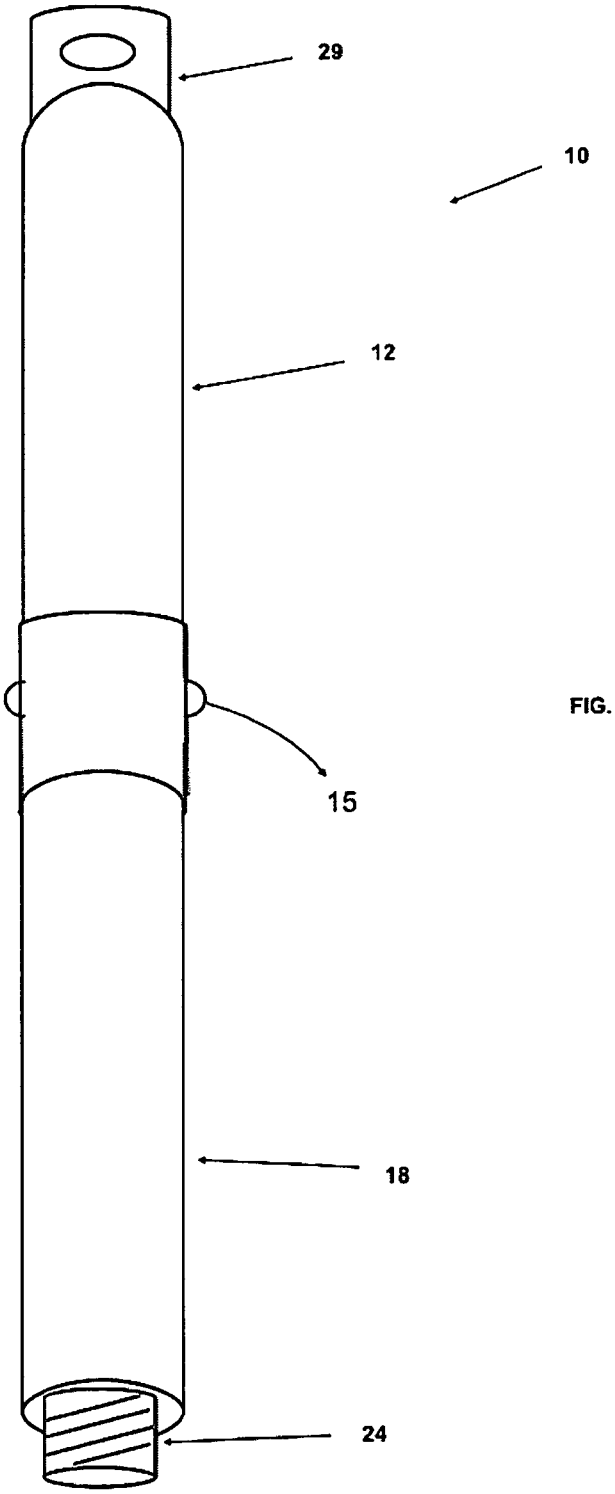
FIG. 1 shows the assembled components of the invention.
Figure 2:
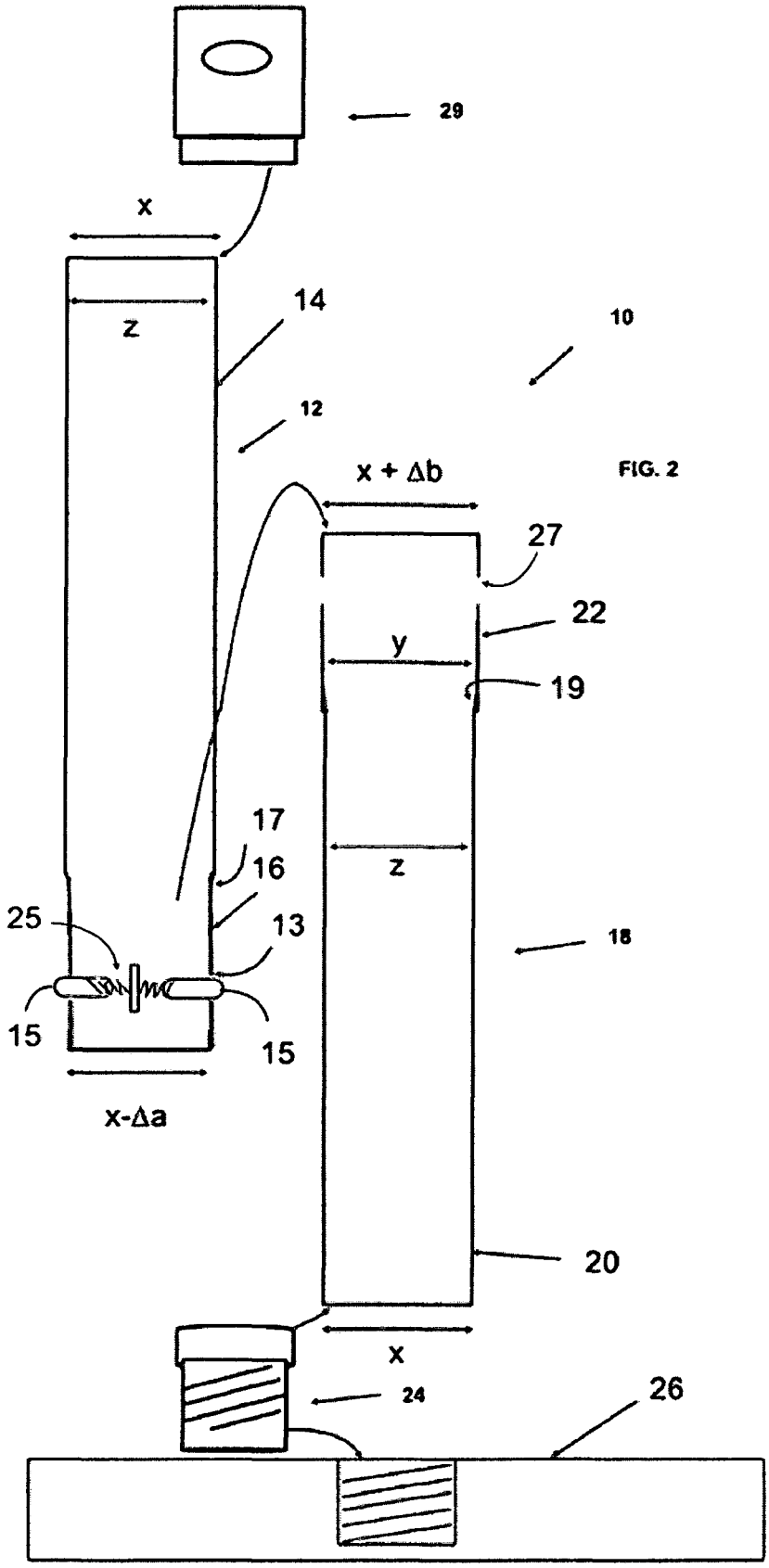
FIG. 2 is a side view drawing of components of the invention prior to formation.
Figure 3:
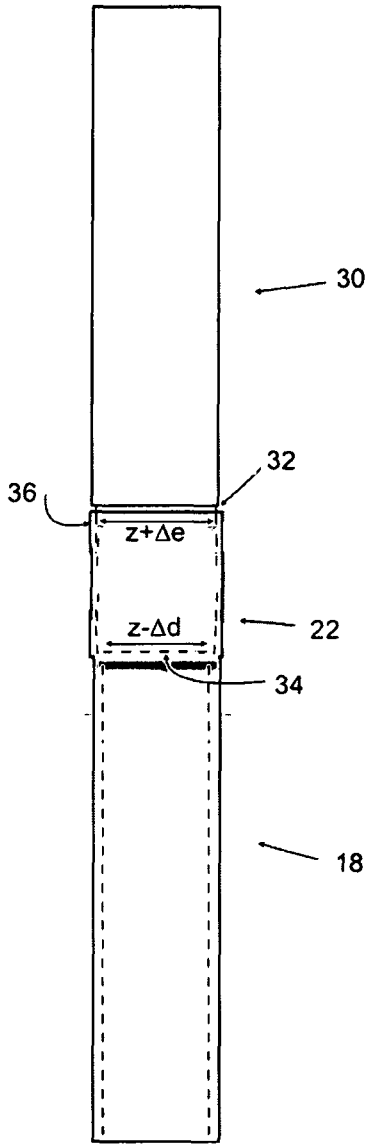
FIG. 3 shows a formation of a male component of the invention.
Figure 4:
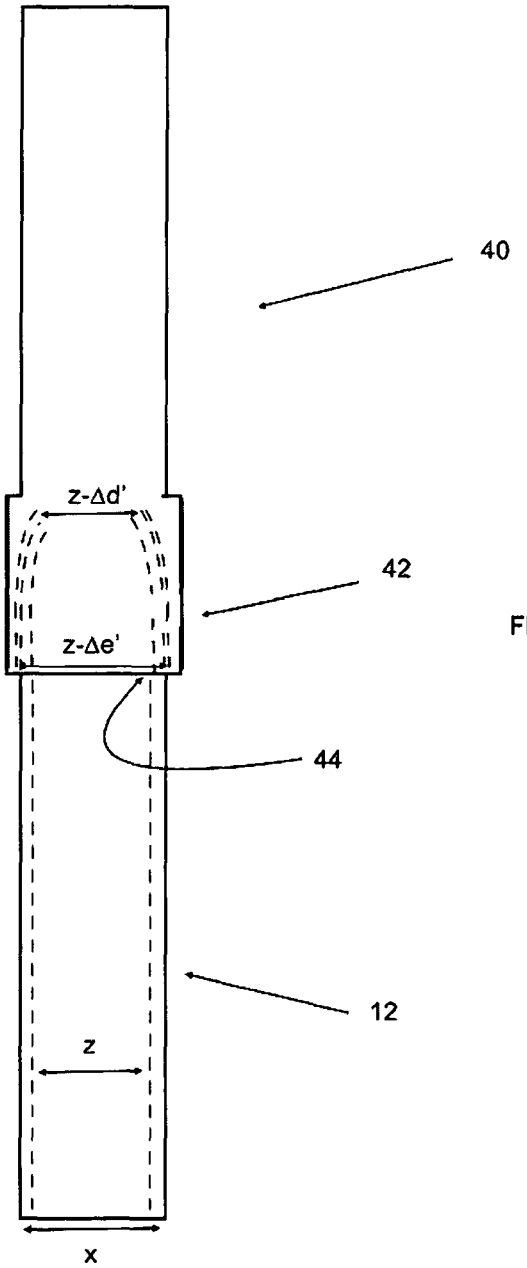
FIG. 4 shows a formation of a female component of the invention.

Referring now to the drawings, the embodiments of the multi-component quick assembly handle of the instant invention is generally designated by the numerals 10 and 10' where like numbers refer to like parts. The multi-component quick assembly handle 10 and 10' includes a first tubular member 12 and 12' made of a permanently deformable material, such as aluminum or other extrudable metal material, for example. By "permanently deformable" it is understood that the material can be subjected to forces which cause it to take on a new permanent shape. The member 12 has a first end 14 formed with a predetermined diameter (x) and connecting to a second end 16 forming a remaining portion of the first tubular member 12 which is a smaller diameter (x−Δa) wherein the first end 14 connects to the second end 16 by way of a tapered section 17. The second end 16 has at least one, and preferably a pair of coaxially aligned, open surface(s) 13 extending through the second end 16. Operably disposed in the second end 16 is a pin 15 biased by a spring/stop mechanism 25 to normally extend the pin 15 outside the open surface(s) 13 but is capable of being depressed toward an interior of the second end 16.

There is also a second tubular member 18 made of a permanently deformable material preferably similar to that described above and having a first end 20 with a predetermined diameter (x) substantially that of the first end 14 of the first tubular member 12 and connecting a second end 22 forming a remaining portion of the second tubular member 18. The second end 22 has a larger diameter (x+Δb) and an inner diameter (y) slightly larger than diameter (x−Δa) which is to complementary receive by way of a friction fit the second end 16 of the first tubular member 12. The second end 22 has at least one (and preferably a pair of coaxially aligned) open surface(s) 27 extending through the second end 22. With the pin 15 depressed, the second ends 16 and 22 can be connected and the respective open surface(s) 13 and 27 can be coaxially aligned and the pin 15 released to a relaxed position and thereby lock the tubular members 12 and 18 in a relatively friction fit fixed position yet permitting separability thereof.

The first end 20 connects to the second end 22 by way of a tapered section 19. At least one of the first ends, 14 or 20, e.g., 14 has a connector 24, e.g., which can be a press fit threaded connector, for connecting a cleaning head 26, such as a mop or broom, to form a cleaning implement. The connector 24 piece does not necessarily require a thread, for example, in the case of a broom the connector 24 can have an end wound directly thereto or a piece of mop hardware could be riveted on thereto. Additionally, there can be provided an end plug or handle cap 29 with an eyelet for press-fit into either end 20 or 14 for permitting hanging and storage of the cleaning implement.

A method of forming multi-component quick assembly handle 10 is also provided. The method includes the steps of providing a first tubular member 12 and a second tubular member 18 of a first predetermined inner diameter (z) and a second predetermined outer diameter (x) wherein the tubular members 12 and 18 are made of a permanently deformable material, such as that previously described. The method further provides a female forming tool 30 having a female forming end 32 including a terminal portion 34 of a diameter (z−Δd) smaller than the inner diameter (z) and a section 36 having a maximum outer diameter (z+Δe) slightly larger than the first inner diameter (z) which connects to a remaining portion 38 of the female forming tool 30 and wherein the female forming end 32 is inserted into end 22 of the second tubular member 18 under pressure to permanently deform into female end 22 of the second tubular member 18. It is understood end 54 of intermediate tubular member 50 can be similarly formed.

Further, the method includes providing a male forming tool 40 having a male forming end 42 having an opening 44 with an entry inner diameter (z−Δe') larger than the outer diameter (x) of the tubular members 12, 50, and 18 and an inwardly disposed inner diameter (z−Δd') which is slightly smaller than diameter (z−Δd) of the female forming tool 30. When the male forming end 42 receives under pressure end 16 of the tubular member 12 it permanently deforms end 16 to have outer diameter deformed complementary to be friction fit received into the female end 22 of tubular member 18. It is understood end 52 of intermediate tubular member 50 can be similarly formed and includes pin 60 and open surfaces 62 and 64.

Figure 7:
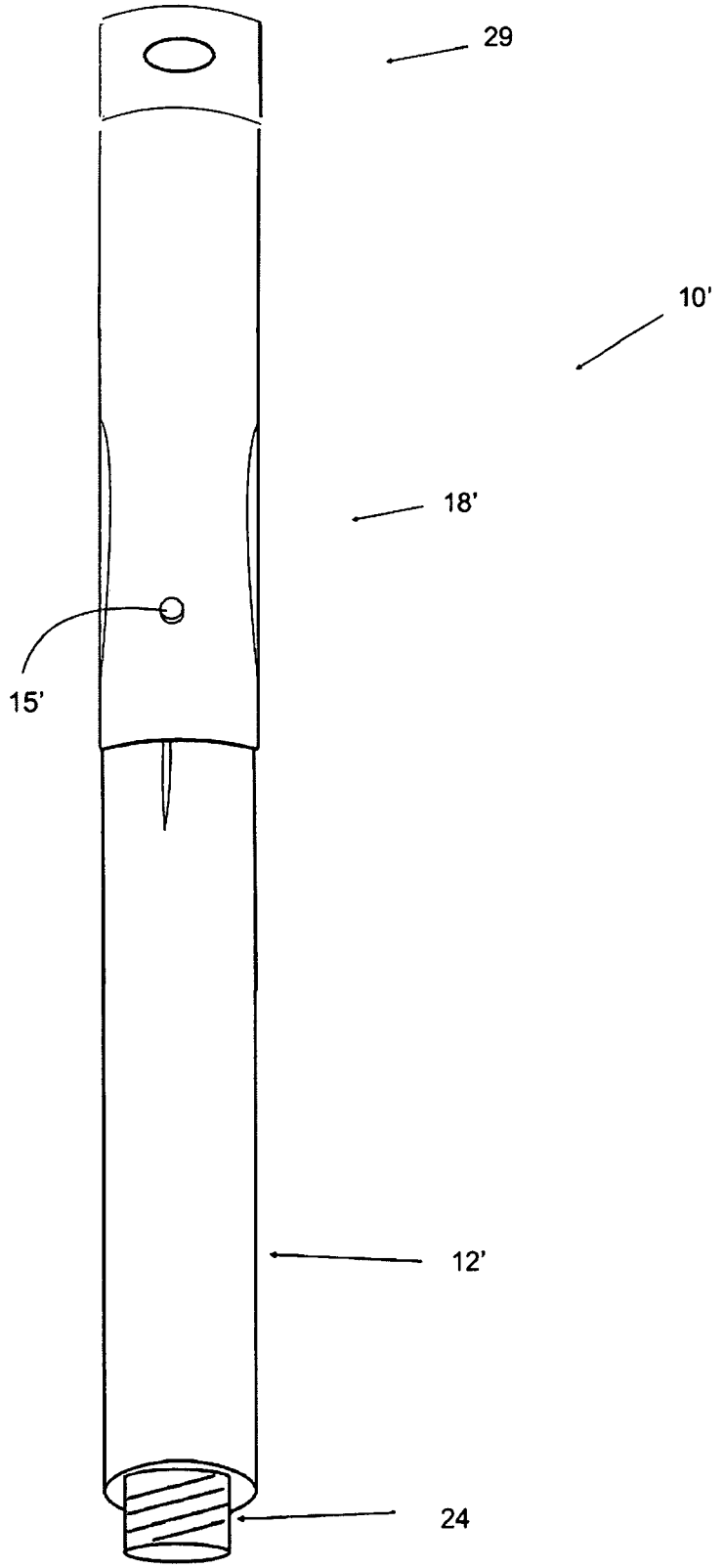
FIG. 7 shows the assembled components of the embodiment of FIG. 6.

The member 12' has a first end 14' formed with a predetermined diameter (x) and connecting to a second end 16' forming a remaining portion of the first tubular member 12' which is a smaller diameter (x−Δa). The second end 16' includes one or more stamped inwardly extending crease 21' to form one or more tapered section 17'. There is also a second tubular member 18' made of a permanently deformable material preferably similar to that described above and having a first end 20' with a predetermined diameter (x) substantially that of the first end 14' of the first tubular member 12' and connecting a second end 22' forming a remaining portion of the second tubular member 18'. The second end 22' has a diameter (x) and an inner diameter (z) which tapers to a smaller inner diameter (z−Δd) which are slightly larger than diameter (x−Δa) to complementary receive by way of a friction fit the second end 16' of the first tubular member 12'. The first end 20' connects to the second end 22' by way of a tapered section 19'. The tapered section 19' is formed by tube pinching process whereby a press sandwiches about the end 22' pinching sides of the same to form outwardly extending pinched portions 23'. At least one of the first ends, 14' or 20', e.g., 14 has a connector 24, e.g., which can be a press fit threaded connector, for connecting a cleaning head 26, such as a mop or broom, to form a cleaning implement. The connector 24 piece does not necessarily require a thread, for example, in the case of a broom the connector 24 can have an end wound directly thereto or a piece of mop hardware could be riveted on thereto. Additionally, there can be provided an end plug or handle cap 29 with an eyelet for press-fit into either end 20' or 14' for permitting hanging and storage of the cleaning implement. FIG. 7 illustrates that the parts 18' and 12' can serve as top of bottom parts.

A method of forming multi-component quick assembly handle 10' is also provided. The method includes the steps of providing a first tubular member 12' and a second tubular member 18' of a first predetermined inner diameter (z) and a second predetermined outer diameter (x) wherein the tubular members 12' and 18' are made of a permanently deformable material, such as that previously described. The method further provides a pinching tool (not shown) including a portion for receiving end 22' and pinching opposing sides thereof thus providing of a diameter (z−Δd) smaller than the inner diameter (z).

Figure 8:
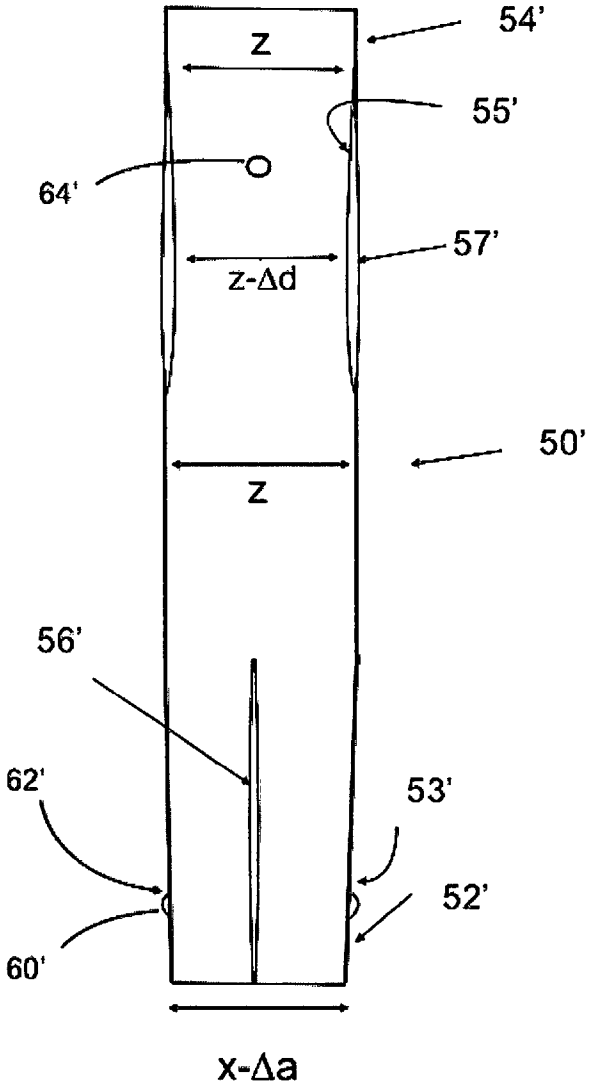
FIG. 8 shows an additional member for the embodiment of FIG. 6.

Further, the method includes providing a male forming tool (not shown) having a crimping receiving end forming crimps 21' in end 16' thereby providing a tapered surface. The ends 16' and 22' are permanently deformed. FIG. 8 illustrates an additional interconnecting member 50'. It is understood that there can be multiple complementary formed members 12', 18', 50'. Member 50' includes tapered sections 53' and 55' formed by crimp(s) 56' and pinched portion(s) 57'.

The formed male end 16/16' and female end 22/22' are of a minimal tolerance to cause the same to become substantially permanently connected when press fit to each other. The method further includes providing cleaning head 26, such as a mop or broom, providing cleaning head connector 24 and connecting the same to end 14, for example, to form a cleaning implement.

By so providing, the instant invention, there is an advantage in that the tubular members enable the connection to become substantially permanent press-fit where they are put together only once. The interconnectable tubular members 12, 12' and 18, 18' members (optional 50 or like formed member) enable the shipment in a smaller box. The very popular Swiffer™ is an example of an existing cleaning implement which can be dis-assembled but rarely is wherein the instant invention can provide an improved multi-piece handle that is easy to put together but nearly impossible to take apart all while being easily shipped.

Figure 5:
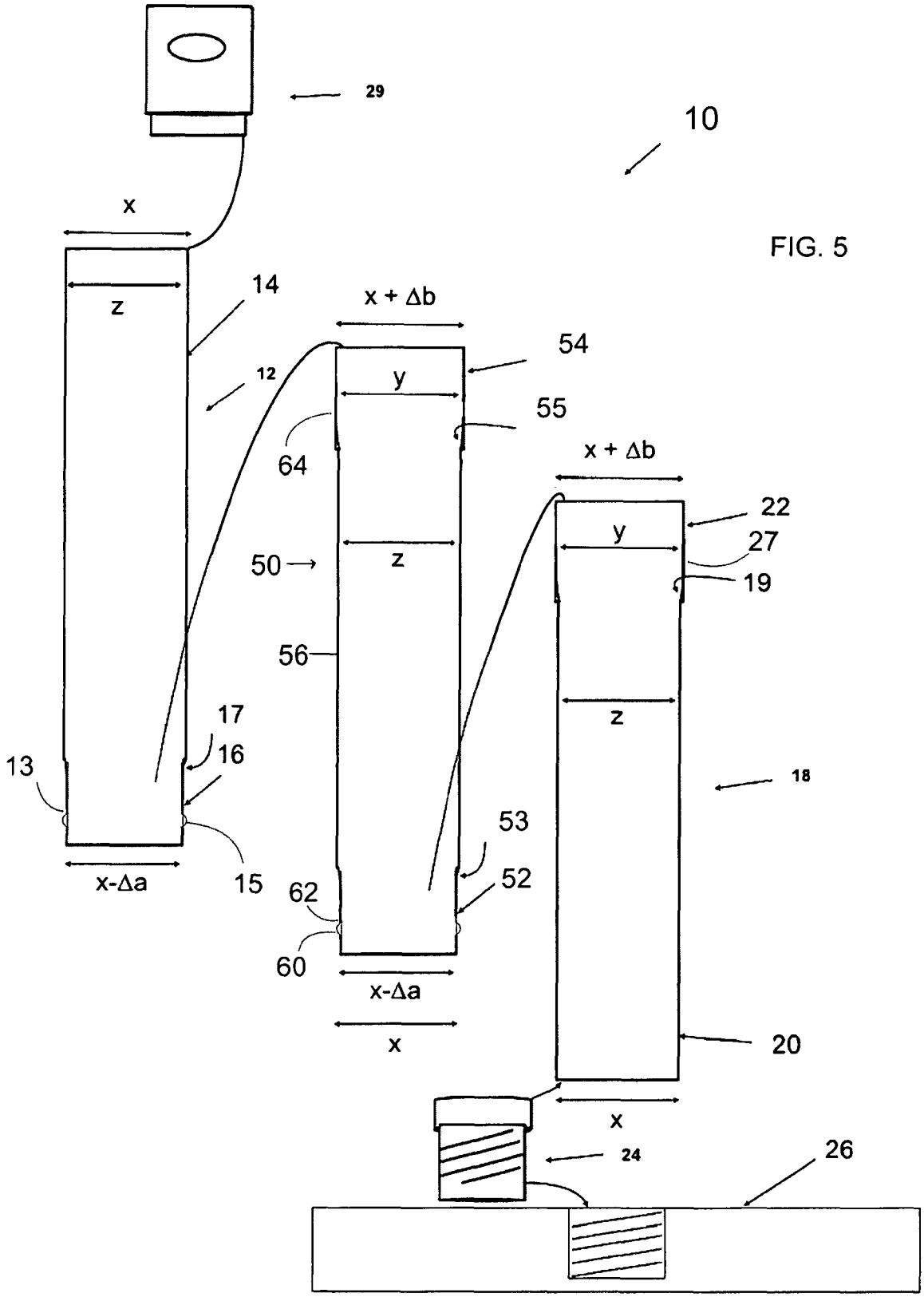
FIG. 5 depicts another embodiment of the invention.
Figure 6:
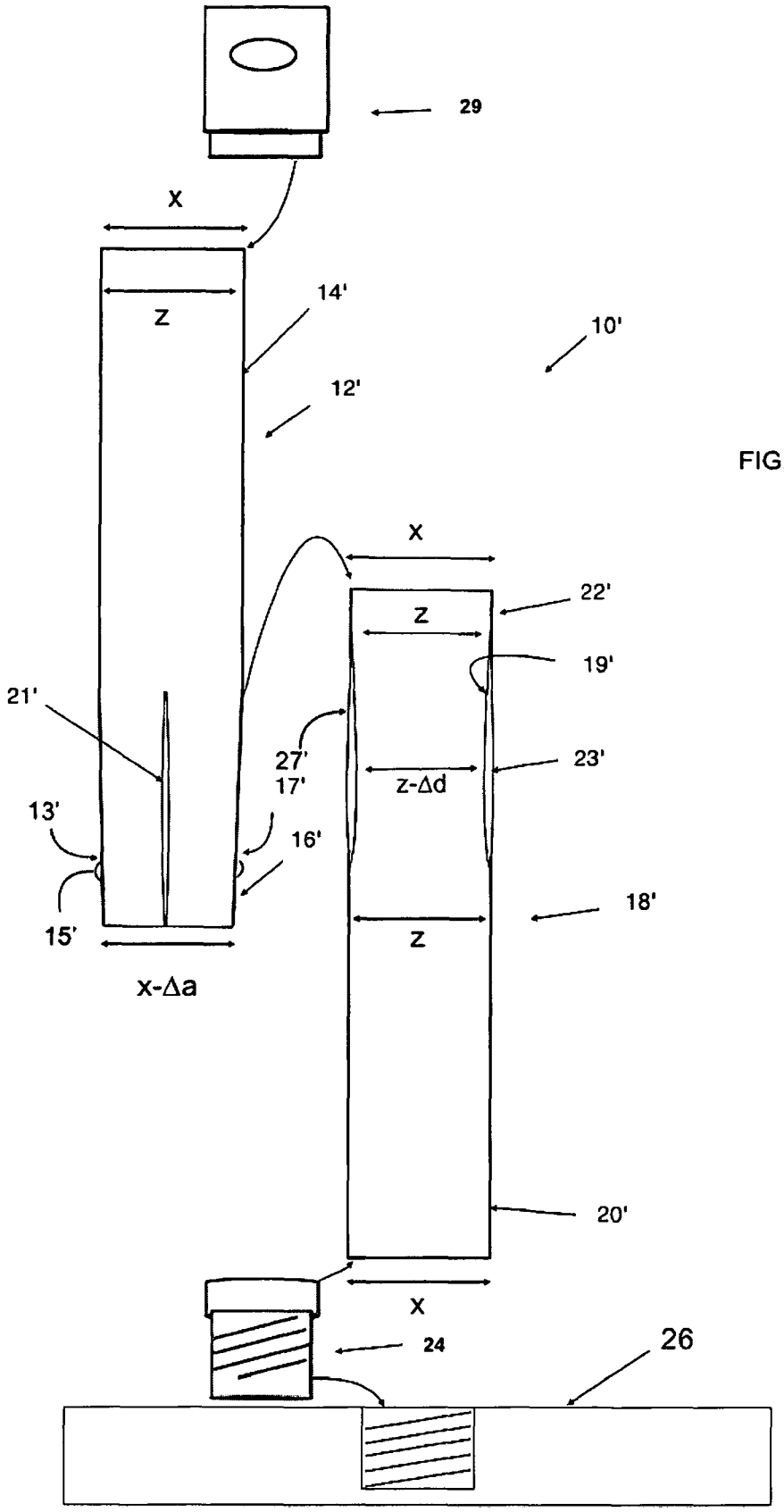
FIG. 6 is a side view drawing of components of another embodiment the embodiment of the invention prior to formation.

It is contemplated that there can be more than two tubular members, such as three, four or five members, in which case interconnecting set of ends can be similarly formed to that described above and as such the middle tubular member would have both ends modified to have any combination of male/female ends. FIG. 5 depicts intermediate tubular member 50 having a similarly formed smaller end 52 and enlarged end 54. The end 52 connects to an intermediate section 56 by way of a tapered section 53 and The end 54 connects to an intermediate section 56 by way of a tapered section 55. Thus, if a 60 inch handle is desired, it could be made of four 15 inch, three 20 inch or two 30 inch pieces to make a 60 inch which is the standard length for may cleaning tools. So, a 24 inch push broom could come with three 20 inch pieces in a compact 24 inch shipping box.

A use of the invention can be for lobby dust pans, where all handles are currently desirably 30 inch and prior hereto required a 30 inch long box. The dust pan may be only 15 inch and with the instant invention two pieces about 15 inch long can be employed so that the lobby dust pan and handle would fit nicely into a box which is about 15 inch long saving both box cost and shipping costs and storage space costs.

Other modifications, derivations and improvements will be readily apparent to those skilled in the art. Accordingly, the appended claims hereto should be afforded the coverage of such modifications, derivations and improvements.

What is claimed is:

1. A multi-component quick assembly handle, which includes: a first tubular member (12) made of a permanently deformable material and having a first end (14) of said first tubular member formed with a predetermined first diameter (x) and connecting to a second end (16) of said first tubular member of a smaller second diameter (x−Δa), said second end (16) having at least one open surface (13) of said first tubular member extending through the second end (16) and a first pin (15) operably disposed in said second end (16) in said first tubular member biased to normally extend outside said open surface (13) and capable of being depressed toward an interior of said second end (16); a second tubular member (18) made of a formed material having a first end (20) of said second tubular member with a predetermined third diameter (x) and connecting a second end (22) of said second tubular member having a larger fourth diameter (x+Δb) and an inner fifth diameter (y) slightly larger than second diameter (x-Aa) of said first tubular member to complementary receive by way of a friction fit said second end (16) of said first tubular member (12), said second end(22) having an open surface (27) of said second tubular member extending through the second end (22) of said second tubular member, and wherein when said first pin (15) is depressed, said second ends (16) and (22) can be connected and said respective open surfaces (13) and (27) can be coaxially aligned and said first pin (15) released to a relaxed position and thereby lock said tubular members (12) and (18) in a relatively friction fit fixed position yet permitting separability thereof.

2. The multi-component quick assembly handle of claim 1, wherein said first end (14) of said first tubular member connects to said second end (16) of said first tubular member by way of a tapered section (17) and said first end (20) of said second tubular member connects to said second end (22) of said second tubular member by way of a tapered section (19).

3. The multi-component quick assembly handle of claim 1, wherein at least one of said first ends (14, 20) of said first tubular member or said second tubular member has a connector (24) for connecting a cleaning head (26).

4. The multi-component quick assembly handle of claim 3, which includes a cleaning head (26) to form a cleaning implement.

5. The multi-component quick assembly handle of claim 1, wherein said tubular members are made from an extrudable metal material.

6. The multi-component quick assembly handle of claim 1, wherein at least one of said first ends (14, 20) of said first tubular member and said second tubular member has an end plug (29) with and eyelet connected thereto.

7. The multi-component quick assembly handle of claim 1, wherein said first tubular member (12) has made an inner diameter (z) an intermediate tubular member (50) made of a formed material with a predetermined diameter (x) and inner diameter (z) having a first end (52) of said intermediate tubular member of a smaller diameter (x−Δa) having at least one open surface (62) of said intermediate tubular member extending through the second end (52) and a second pin (60) operably disposed in said first end (52) of said intermediate tubular member biased to normally extend outside said open surface (62) of said intermediate tubular member, said first end (52) of said intermediate tubular member connecting an intermediate section (56) of said intermediate tubular member which in turn connects to a second end (54) of said intermediate tubular member having a larger diameter (x+Δb) and an inner diameter (y) slightly larger than diameter (x−Δa) of said first tubular member and includes at least one open surface (64) of said intermediate tubular member extending therethrough, said second end (54) of said intermediate tubular member to complementary receive by way of a friction fit said second end (16) of said first tubular member (12), and wherein when said first pin (15) is depressed, said second ends (16) and (54) of said first tubular member (12) and said intermediate tubular member (50), respectively, can be connected and said respective open surfaces (13) and (64) can be coaxially aligned and said first pin (15) released to a relaxed position and thereby lock said first and intermediate tubular members (12) and (18) in a relatively friction fit fixed position yet permitting separability thereof; and a second tubular member (18) of said second tubular member made of a formed material with a predetermined diameter (x) and an inner diameter (z) and having a first end (20) of said second tubular member with a predetermined diameter (x) and connecting a second end (22) of said second tubular member having a larger diameter (x+Δb) and an inner diameter (y) slightly larger than diameter (x−Δa) of said intermediate tubular member to complementary receive by way of a friction fit said first end (52) of said intermediate tubular member (50), said second end (22) of said second tubular member having an open surface (27) extending through the second end (22) of said second tubular member, and wherein when said second pin (60) is depressed, said ends (52) and (22) can be connected and said respective open surfaces (62) and (27) can be coaxially aligned and said second pin (60) released to a relaxed position and thereby lock said intermediate and second tubular members (50) and (18) in a relatively friction fit fixed position yet permitting separability thereof.

8. The multi-component quick assembly handle of claim 7, wherein said first end (14) of said first tubular member connects to said second end (16) of said first tubular member by way of a tapered section (17) of said first tubular member, said ends (52, 54) of said intermediate tubular member 50 connect to said intermediate section (56) by way of a tapered sections (53, 55) of said intermediate tubular member and said first end (20) of said second tubular member connects to said second end (22) of said second tubular member by way of a tapered section (19) of said second tubular member.

9. The multi-component quick assembly handle of claim 7, wherein at least one of said first ends (14, 20) of said first tubular member and said second tubular member has a connector (24) for connecting a cleaning head (26).

10. The multi-component quick assembly handle of claim 9, which includes a cleaning head (26) to form a cleaning implement.

11. The multi-component quick assembly handle of claim 7, wherein said tubular members are made from an extrudable metal material.

12. The multi-component quick assembly handle of claim 7, wherein at least one of said first ends (14, 20) of said first tubular member and said second tubular member has an end plug (29) with and eyelet connected thereto.

13. A multi-component quick assembly handle, which includes: a first tubular member (12') made of a permanently deformable material and having a first end (14') of said first tubular member formed with a predetermined diameter (x) and connecting to a second end (16') of said first tubular member of a smaller diameter (x−Δa), said second end (16') of said first tubular member having at least one open surface (13') in said first tubular member extending through the second end (16') of said first tubular member and a first pin (15') operably disposed in said second end (16') of said first tubular member biased to normally extend outside said open surface (13') and capable of being depressed toward an interior of said second end (16') of said first tubular member; a second tubular member (18') made of a permanently deformable material having a first end (20') of said second tubular member with a predetermined diameter (x) and connecting a second end (22') of said second tubular member having a diameter (x) and an inner diameter (z) which tapers to an inner diameter (z-Ad) which are slightly larger than diameter (x−Δa) of said first tubular member to complementary receive by way of a friction fit said second end (16') of said first tubular member (12'), said second end(22') of said second tubular member having an open surface (27') extending through the second end (22'), and wherein when said first pin (15') is depressed, said second ends (16') and (22') of said first and second tubular members can be connected and said respective open surfaces (13') and (27') of said first and second tubular members can be coaxially aligned and said first pin (15') released to a relaxed position and thereby lock said first and second tubular members (12') and (18') in a relatively friction fit fixed position yet permitting separability thereof.

14. The multi-component quick assembly handle of claim 13, wherein said second end (16') of said first tubular member includes at least one stamped inwardly extending crease (21') to form at least one tapered section (17') of said first tubular member and said second end (22') of said second member (18') includes at least one outwardly extending pinched portion (23').

15. The multi-component quick assembly handle of claim 13, wherein at least one of said first ends (14', 20') of said first and second tubular members has a connector (24) for connecting a cleaning head (26).

16. The multi-component quick assembly handle of claim 15, which includes a cleaning head (26) to form a cleaning implement.

17. The multi-component quick assembly handle of claim 13, wherein said tubular members are made from an extrudable metal material.

18. The multi-component quick assembly handle of claim 13, wherein at least one of said first ends (14', 20') has a handle cap (29) with and eyelet therein.

19. The multi-component quick assembly handle of claim 13, wherein said first tubular member (12') has material formed with an inner diameter (z) an intermediate tubular member (50') made of a permanently deformable material formed with a predetermined diameter (x) and inner diameter (z) having a first end (52') of said intermediate tubular member of a smaller diameter (x−Δa) having at least one open surface (62') of said intermediate tubular member extending through the second end (52') of said intermediate tubular member and a second pin (60') operably disposed in said first end (52') biased to normally extend outside said open surface (62') of said intermediate tubular member, said first end (52') of said intermediate tubular member connecting to an intermediate section (56') of said intermediate tubular member which in turn connects to a second end (54') of said intermediate tubular member having an inner diameter (z) tapering to an inner diameter (z−Δd) which are slightly larger than diameter (x−Δa) of said first tubular member to complementary receive by way of a friction fit said second end (16') of said first tubular member (12'), said second end (54') of said intermediate tubular member includes at least one open surface (64) extending through to complementary receive by way of a friction fit said second end (16') of said first tubular member (12'), and wherein when said first pin (15') is depressed, said second ends (16') and (54') of said first and intermediate tubular members can be connected and said respective open surfaces (13') and (64') of said first and intermediate tubular members can be coaxially aligned and said first pin (15') released to a relaxed position and thereby lock said first and intermediate tubular members (12') and (50') in a relatively friction fit fixed position yet permitting separability thereof; and a second tubular member (18') made of a formed material having a first end (20') of said second tubular member with a having a diameter (x) and an inner diameter (z) and connecting a second end (22') of said second tubular member having a diameter (x) and an inner diameter (z) which tapers to an inner diameter (z−Δd) which are slightly larger than diameter (x−Δa) of said first tubular member to complementary receive by way of a friction fit said second end (52') of said second tubular member (12') , said second end (22') of said second tubular member having an open surface (27') extending through the second end (22'), and wherein when said second pin (60') is depressed, said ends (52') and (22') of said intermediate and second tubular members can be connected and said respective open surfaces (62') and (27') of said intermediate and second tubular members can be coaxially aligned and said second pin (60') released to a relaxed position and thereby lock said intermediate and second tubular members (50') and (18') in a relatively friction fit fixed position yet permitting separability thereof; wherein at least one of said first ends (14', 20') of said first and second tubular members has a connector (24) for connecting a cleaning head (26) and includes a cleaning head (26) to form a cleaning implement, and wherein at least one of said first ends (14', 20') of said first and second tubular members has a handle cap (29) with and eyelet therein.

20. The multi-component quick assembly handle of claim 19, wherein said tubular members are made from an extrudable metal material.

* * * * *